US011273339B2

(12) United States Patent
Rice

(10) Patent No.: US 11,273,339 B2
(45) Date of Patent: Mar. 15, 2022

(54) ATHLETIC COVER FOR A WORKOUT EQUIPMENT

(71) Applicant: Walter A. Rice, Cincinnati, OH (US)

(72) Inventor: Walter A. Rice, Cincinnati, OH (US)

( * ) Notice: Subject to any disclaimer, the term of this patent is extended or adjusted under 35 U.S.C. 154(b) by 111 days.

(21) Appl. No.: 15/330,944

(22) Filed: Oct. 23, 2015

(65) Prior Publication Data

US 2019/0351282 A1 Nov. 21, 2019

Related U.S. Application Data

(60) Provisional application No. 62/067,964, filed on Oct. 23, 2014.

(51) Int. Cl.
*A63B 21/00* (2006.01)

(52) U.S. Cl.
CPC ..... *A63B 21/4037* (2015.10)

(58) Field of Classification Search
CPC ..... A63B 21/4037; A63B 1/00; A63B 6/00; A63B 23/0211; A47K 10/02
See application file for complete search history.

(56) References Cited

U.S. PATENT DOCUMENTS 4,403,366 A * 9/1983 Lucke ..... A47K 10/02 15/209.1
5,724,698 A * 3/1998 Mondragon ..... A47K 10/02 15/209.1
5,950,260 A * 9/1999 Dees ..... A47C 9/02 5/420
6,866,337 B1 * 3/2005 Lash ..... A47C 31/11 297/188.2
2002/0185898 A1 * 12/2002 Smith ..... A47C 31/11 297/224
2004/0055659 A1 * 3/2004 Hugh Silver ..... D03D 27/08 139/396
2005/0206207 A1 * 9/2005 Kenny ..... A47C 31/11 297/228.1
2008/0004168 A1 * 1/2008 Jackson ..... A47C 31/11 482/148
2008/0214361 A1 * 9/2008 Oster ..... A63B 6/00 482/23
2008/0303230 A1 * 12/2008 Somberg ..... B62B 5/06 280/33.992
2010/0178821 A1 * 7/2010 Morris ..... A47K 10/02 442/1

(Continued)

FOREIGN PATENT DOCUMENTS

CA 2382402 A1 * 11/2003 ..... A45F 4/02

*Primary Examiner* — Michael Zhang
(74) *Attorney, Agent, or Firm* — Christopher Mayle; Bold IP, PLLC

(57) ABSTRACT

A workout mat for placement onto a workout apparatus is provided. The workout mat includes a body having a first side and a second side, the second side of the body being positioned opposite to the first side and a top portion connected adjacently to the body. The top portion of the workout mat has a first side and a second side positioned oppositely to the first side, the second side of the top portion being attached to the first side. The workout apparatus has a workout surface, whereby the workout surface is contactable by a human user. The workout apparatus includes a headrest, whereby the headrest is at least partially hydrophobic.

8 Claims, 5 Drawing Sheets

(56) References Cited

U.S. PATENT DOCUMENTS

| | | | | |
|---|---|---|---|---|
| 2010/0197471 | A1* | 8/2010 | Hayes | A63B 6/00<br>482/140 |
| 2011/0114235 | A1* | 5/2011 | Hartley | A63B 71/00<br>150/154 |
| 2012/0137431 | A1* | 6/2012 | Pittman | A47G 9/062<br>5/417 |
| 2012/0210517 | A1* | 8/2012 | Patel | B32B 5/024<br>8/137 |
| 2014/0338210 | A1* | 11/2014 | Young | B32B 5/26<br>34/95 |
| 2015/0047646 | A1* | 2/2015 | Marinkovic | A47G 9/1081<br>128/845 |
| 2015/0141221 | A1* | 5/2015 | Delgado | A63B 23/0211<br>482/140 |
| 2016/0303460 | A1* | 10/2016 | Seilus | A63B 71/00 |

* cited by examiner

ATHLETIC COVER FOR A WORKOUT EQUIPMENT

FIELD OF THE INVENTION

The invention herein provides a reusable workout mat that acts as a barrier between an exerciser and work-out equipment. Specifically, the invention provides a workout mat that is attachable to such equipment, provides a barrier, is alternately moisture absorbent, moisture wicking, and/or enables evaporation of moisture and is light weight for ready and easy transport throughout a gym.

BACKGROUND OF THE INVENTION

Working out in the gym is a common occurrence. People in various locales have added a consistent workout regime to their lives. Also, many gyms have become social outlets for their members.

Typical gyms contain workout equipment designed to hold or balance a user while she lifts, pulls or rotates some sort of weight. Such equipment receives a user's body, either the upper torso, legs or both. When an exerciser perspires, such perspiration transfers to the workout equipment. Unless an exerciser removes the perspiration by wiping the workout equipment, it will remain there until it evaporates. An even worse instance is when a previous user leaves his perspiration on workout equipment without wiping it down. That too happens often and is the source of unwanted bacterial and viral transfer.

If work-out equipment is not wiped down and preferably cleaned, its residual perspiration can be transferred to another user if used again. At the least, leaving perspiration on a work-out machine is an inconvenience to other exercisers. At worst, it can be a source of disease to other exercisers if such perspiration carries bacteria or viral material.

Tens of millions of people work-out in gyms daily. That creates millions of opportunities for perspiration transfer. Ideally, a way should be made to either prevent, or at least drastically limit, the transfer of perspiration from an exerciser to work-out equipment and from such equipment to the same or other exerciser.

One suitable way to impede the transfer of perspiration to work-out equipment is to provide a barrier between an exerciser and such equipment. That barrier would need to be moveable, light-weight, reusable, does not retain acquired moisture, at least partially hydrophobic, if substantially or totally so, and aesthetically pleasing to a user.

Thus, a mere towel is insufficient, especially since towels are moisture absorbent and tend to retain moisture for a long time. Also, once a towel is used and carried throughout a gym, a user can forget which side is the 'down' side, i.e., the side that touches the exercise equipment, and which side is the 'up' side, i.e., which side does not touch the workout equipment but instead touches the user. What remains then is a solution that meets all of the aforementioned needs.

As is well known, workout facilities are notoriously hot, humid, and germ infested environments. Such environments readily bread any number of disease spreading germs and viruses. State and local health departments inspect these facilities, but their diligence is not enough. Daily and weekly users of such facilities routinely put their health at risk by seeking to shed a few pounds at these locales. What is also needed, therefore, is a way by which an exerciser can protect himself from acquiring such germs and viruses thereby remaining well.

BRIEF SUMMARY OF THE INVENTION

Accordingly, a workout mat for placement onto a workout apparatus is provided that has a body and a top portion. The body has a first side and a second side, the second side of the body being positioned oppositely to the first side. The top portion is connected adjacently to the body and has a first side and a second side positioned oppositely to said first side. The second side of the top portion is attached to the first side of the body. In practice, the workout apparatus comprises a workout surface that is contactable by a human user.

The workout mat may further comprise a head rest that is removably attached to the first side of the top portion. The headrest is configured to receive a head of a human user when using the workout mat. The headrest comprises a bulbous member and an outer layer. The outer layer substantially covers the bulbous member. The headrest can be sculpted to receive a user's head so that the user's head made to be comfortable and, especially, properly supported during rigorous exercise.

Like the workout mat, the headrest is at least partially hydrophobic. Ideally, the headrest is at least substantially hydrophobic. Most ideally, material of the headrest will aid in evaporation of moisture that contacts it.

In the instance in which the workout mat does not include a separate headrest, an end portion of the workout mat can itself serve as a non-bulbous headrest by wrapping it around a portion of an end of a workout apparatus. The first side and second side of the top portion comprises a frictional surface. When placed about one end of a workout apparatus, the top portion hugs that end to further secure the workout mat to the workout apparatus. If the top portion is not used to secure the workout mat to a workout apparatus, it can be used as a head rest for a user as the material of the work-out mat is doubled.

The workout mat is attachable to the workout apparatus. The second side of the workout mat touches and is positionable onto the workout surface on a given exercise machine; e.g., a bench for doing chest presses, a workout chair for doing shoulder presses and the like. Ideally, the second side of the workout mat comprises a frictional surface, such frictional surface providing resistance to movement of the workout mat once it is laid onto exercise equipment.

The first side of the top portion of the workout mat, which is the user contact side, is at least partially hydrophobic. Preferably, it is substantially hydrophobic. Most preferably, it is fully hydrophobic. Whether the workout mat is partially, substantially, or fully hydrophobic, the first side of the top portion is at least partially moisture wicking. In its most ideal application, the first side of the top portion has evaporative properties whereby moisture contacting such top portion is caused to evaporative due to inherent properties thereof.

The workout mat constructed to be used daily and is reusable throughout an exerciser's time in a gym or elsewhere exercising. The workout mat is also conventionally washable and dryable whereby such washing and drying alters none of the provided properties thereof.

BRIEF DESCRIPTION OF THE DRAWINGS

The various exemplary embodiments of the present invention, which will become more apparent as the description proceeds, are described in the following detailed description in conjunction with the accompanying drawings, in which.

DETAILED DESCRIPTION

Figure 1:
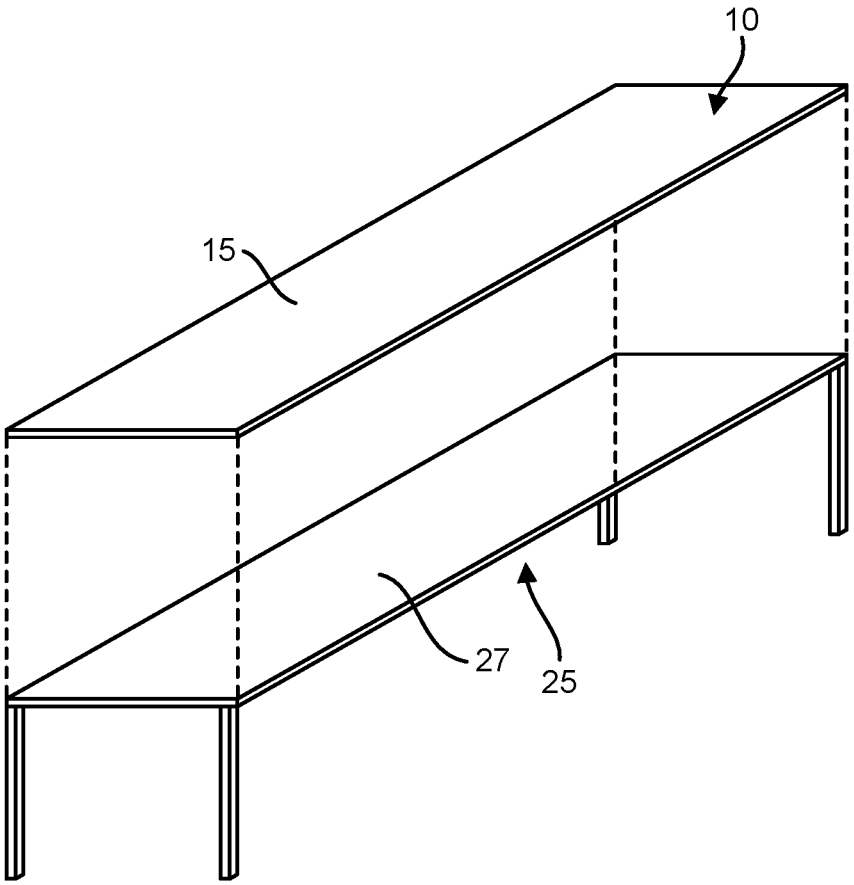
FIG. 1 is an exploded perspective view of the workout mat provided herein being positioned juxtaposed to a work-out bench.

By the term "hydrophobic" it is meant herein moisture resistant, i.e., resistant to the absorption of received moisture from, for example, perspiration.

An invention is provided herein that is a workout mat for placement onto a workout apparatus is provided that has a body and a top portion. The body has a first side and a second side, the second side of the body being positioned oppositely to the first side. The top portion is connected adjacently to the body and has a first side and a second side positioned oppositely to said first side. The second side of the top portion is attached to the first side of the body. In practice, the workout apparatus comprises a workout surface that is contactable by a human user.

The workout mat may further comprise a head rest that is preferably removably attached to the first side of the top portion. The head rest may also be fixedly attached to the first side of the top portion. The headrest is configured to receive a head of a human user when using the workout mat. The headrest comprises a bulbous member and an outer layer. The outer layer substantially covers the bulbous member. The headrest can be sculpted to receive a user's head so that such head is made to be comfortable and, especially, properly supported during rigorous exercise.

Like the workout mat, the headrest is at least partially hydrophobic. Ideally, the headrest is at least substantially hydrophobic. Most ideally, material of the headrest will aid in evaporation of moisture that contacts it.

In the instance in which the workout mat does not include a separate headrest, an end portion of the workout mat can itself serve as a non-bulbous headrest by wrapping it around a portion of an end of a workout apparatus. The first side and second side of the top portion comprises a frictional surface. When placed about one end of a workout apparatus, the top portion hugs that end to further secure the workout mat to the workout apparatus. If the top portion is not used to secure the workout mat to a workout apparatus, it can be used as a head rest for a user as the material of the work-out mat is doubled.

The workout mat is attachable to the work-out apparatus. The second side of the workout mat touches and is positionable onto the workout surface on a given exercise machine; e.g., a bench for doing chest presses, a workout chair for doing shoulder presses and the like. Ideally, the second side of the workout mat comprises a frictional surface, such frictional surface providing resistance to movement of the workout mat once it is laid onto exercise equipment.

The first side of the top portion of the workout mat, which is the user contact side, is at least partially hydrophobic. Preferably, it is substantially hydrophobic. Most preferably, it is fully hydrophobic. Whether the workout mat is partially, substantially, or fully hydrophobic, the first side of the top portion is at least partially moisture wicking. In its most ideal application, the first side of the top portion has evaporative properties whereby moisture contacting such top portion is caused to evaporative due to inherent properties thereof.

The workout mat is constructed to be used daily and is reusable throughout an exerciser's time in a gym or elsewhere exercising. The workout mat is also conventionally washable and dryable whereby such washing and drying alters none of the provided properties thereof.

FIG. 1 is an exploded perspective view of the workout mat provided herein being positioned juxtaposed to a work-out bench. Workout mat 10 is shown in a raised position above workout bench 25. In practice, workout mat 10 is placed onto workout bench 25 and is meant to at least substantially cover workout bench 25. Preferably, workout mat 10 fully covers workout bench 25. Such cover, i.e., substantial or full, is important. Covering workout bench 25 is key to maintaining as clean and sanitary an environment during and after workouts as is possible. Such coverage enables an exerciser to keep his or her sweat from exercise equipment and alleviates the need to later clean such equipment.

In FIG. 1, the top layer 15 of workout mat 10 is shown, this example is non-limiting and merely for illustrative purposes, wherein the mat may be any shape and size known by those of ordinary skill in the art. Such top layer 15 is the surface of workout mat 10 that is meant to be in immediate contact with an exerciser. It is the surface that contacts an exerciser's skin and manages the oils and moisture therefrom. Not shown is placement layer 20. Placement layer 20 is the layer of workout mat 20 that touches and removably adheres to exercise surface 27 thereof. Normally, without workout mat 10, exercise surface 27 of workout bench 25 is the surface upon which an exerciser would touch, either by laying, sitting or the like. Exercise surface 27 is therefore the surface upon which fluid, oil and germs from an exerciser are deposited.

Figure 2:
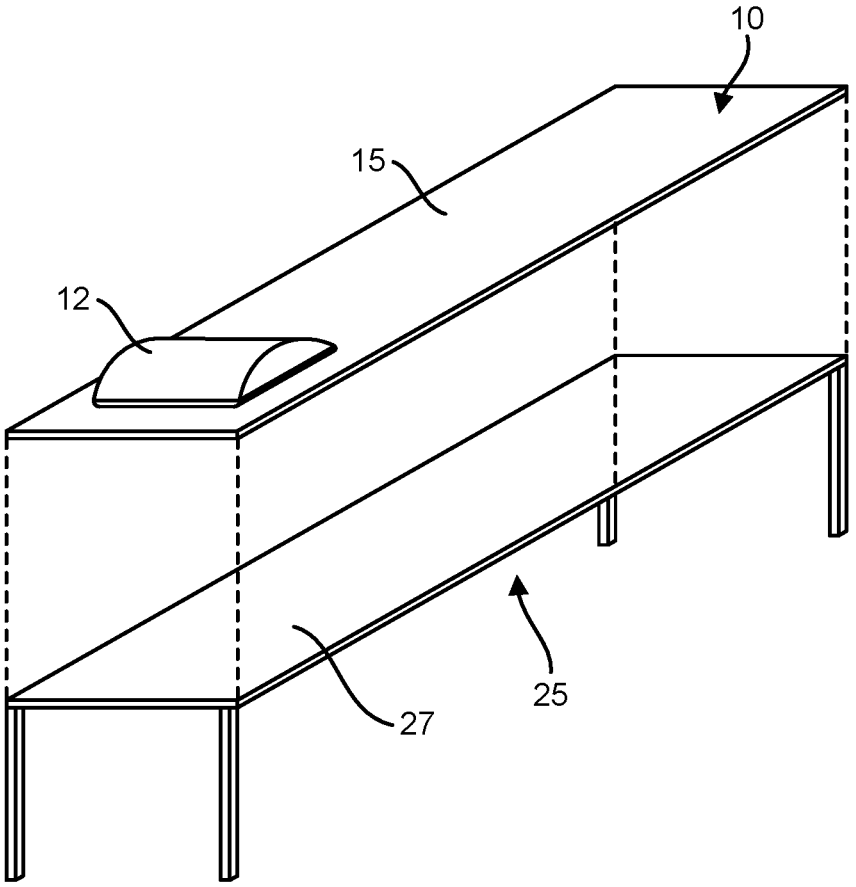
FIG. 2 provides an exploded perspective view of an alternative workout mat provided herein being positioned juxtaposed to a workout bench.

FIG. 2 provides an exploded perspective view of an alternative workout 10 mat provided herein being positioned juxtaposed to a workout bench. FIG. 2 is similar to that of FIG. 1. It shows workout mat 10 in juxtaposition to workout bench 25. FIG. 2 provides an alternative embodiment that includes headrest 12. Headrest 12 is configured to receive the head of an exerciser. In practice, as an exerciser uses workout mat 10 to exercise on workout bench 25, he will lay his head thereon while performing an exercise, e.g., bench press, flies, and the like.

Headrest 12 is meant to provide support and comfort to an exerciser while engaging workout bench 25. Headrest 12 may be constructed from similar materials as that of workout mat 10 or from different materials. Also, headrest 12 is preferably raised a height from workout mat 10. More preferably, headrest 12 is sculpted to receive the known contours of a human head. Alternatively, headrest 12 may comprise a viscoelastic polyurethane foam, or low-resilience polyurethane foam commonly known by persons of skill in the art as "memory foam". Such memory foam in headrest 12 may soften in reaction to a head's heat, allowing it to mold to the head thereby providing support and comfort to an exerciser.

Figure 3:
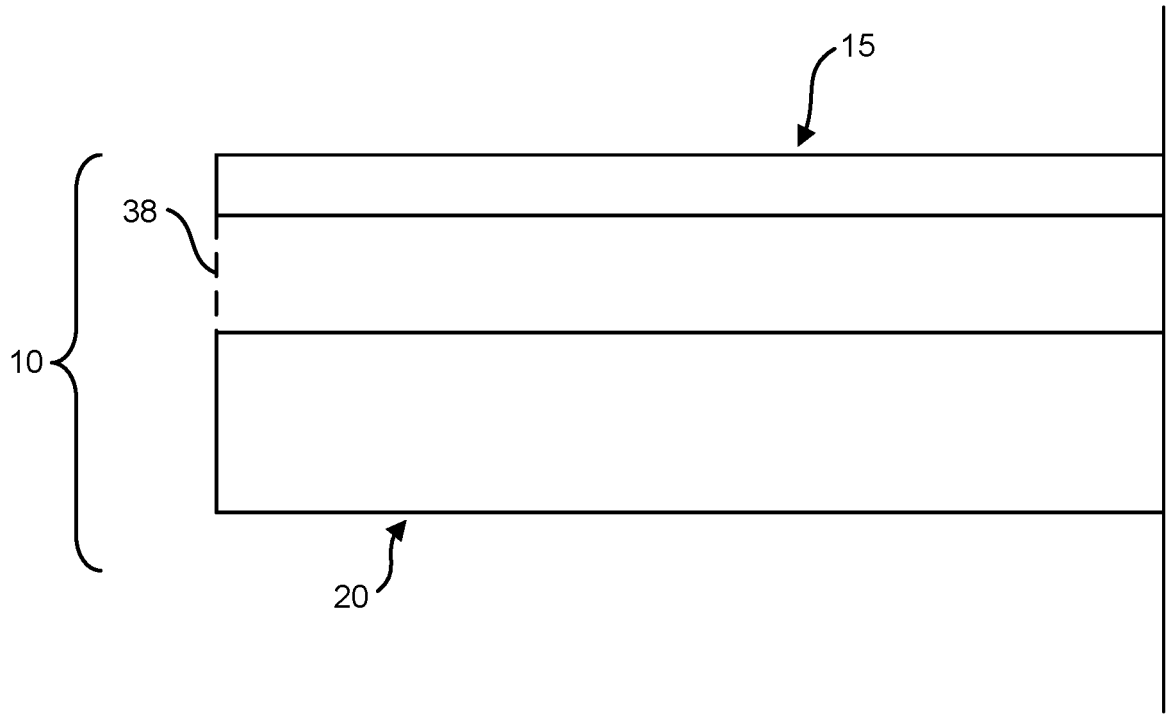
FIG. 3 is a partial side view of the workout mat provided herein.

FIG. 3 is a partial side view of workout mat 10 provided herein. FIG. 3 is meant to show the multi-layer condition of workout mat 10. Though two layers are shown, workout mat 10 is not limited to two layers or the use of only two materials in its construction. What is important is that workout mat 10 is constructed to have at least one layer that is the contact layer to workout bench 25 and at least one layer that is the contact layer to an exerciser.

In FIG. 3, top layer 15 is shown. Such layer is positioned and attached to placement layer 20. Preferably, top layer 15 wicks moisture away from an exerciser and then operates to enable quick evaporation thereof so that top layer 15 maintains a dry feel to the exerciser. Given that workout sessions can be long and exercisers sweat with exertion, it is important that top layer 15 feels dry and non-greasy to an exerciser. This is a key advantage over the use of a common cloth towel in place of workout mat 10. The common towel is typically highly absorbent of moisture, retains such moisture, and provides either poor or mediocre moisture evaporative properties. Also, the common towel looks exactly the same one side as it does on its opposite side. This is a key distinction. An exerciser seeking to avoid use of the side of the towel that contacts exercise equipment must remain diligent to distinguish which side upon which he has deemed the "exercise" side versus the workout bench "placement" side.

Of course, top layer 15 may maintain a wet feel if desired by a manufacturer. Such wet feel means that wicking of received perspiration is minimized. At this minimization, received perspiration is maintained in top layer 15 until it evaporates naturally. In spite of top layer 15 having a wet feel in this embodiment, the placement layer 20 remains impervious to moisture such that moisture contacting top layer 15 never penetrates placement layer 20. This ensures that workout bench 25 remains dry at all times.

Placement layer 20 shown in FIG. 3 is the layer that is placed onto workout bench 25. It is preferably constructed from a material upon which a frictional surface may be formed. Such frictional surface is constructed to resist movement of workout mat 10 once it is placed onto workout bench 25. In practice, workout mat 10 is easily movable at the intended movement of an exerciser, but resists motion for unintended movement thereof. For example, the common towel has no such placement layer that frictionally resists motion thereof when an exerciser uses workout bench 25. In use, common towel can tend to become displaced thus causing an exerciser to stop exercising to replace the common towel into a position of coverage and protection.

In practice, top layer 15 and placement layer 20 are attached in such a manner as to prevent the removal of one layer from the other. Top layer 15 may be bonded to placement layer 20 by thermal bonding, adhesive bonding or other suitable bonding methods known by persons of skill in the art for such purposes. The bonding method is itself uncritical to the operation of workout mat 10. What is critical is that a proper bond be formed so that top layer 15 cannot be readily removed from placement layer 20.

A preferred material for placement layer 20 of workout mat 10 herein is neoprene. Neoprene is an oil resistant synthetic rubber or rubber like material. Suitably, unaltered rubber may also be used as the substantial material of placement layer 20 of workout mat 10. Thickness of top layer 15 preferably ranges from about two millimeters to about five millimeters (i.e., 2 mm to 5 mm). As noted hereinabove, top layer 15 of workout mat 10 is preferably moisture resistant. By the term "moisture resistant", it is meant herein that its top surface resists the absorption of moisture applied to it. By the term "wick" it is meant herein that material on the first side of the body draws off moisture (or any liquid) by capillary action.

Figure 4:
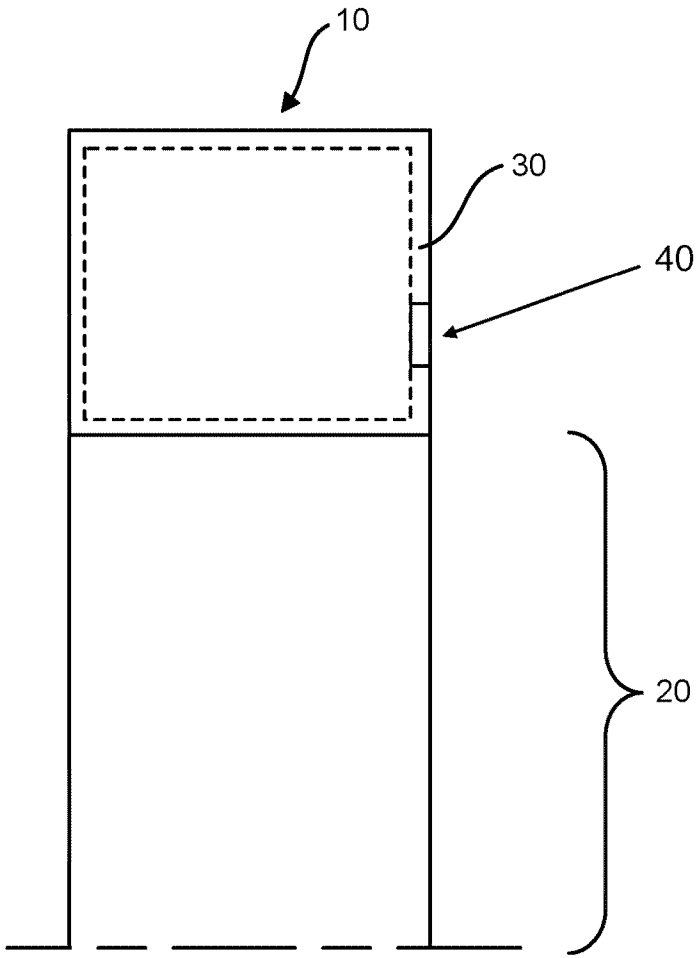
FIG. 4 is a partial planar view of the workout mat pocket for securement to a workout bench.

It is also important to point out that top layer 15 may comprise two or more layers to affect key features for its operation. For example, top layer 15 may comprise two layers and be structurally bi-furcated. In one embodiment thereof herein, a surface layer of top layer 15 may comprise a porous substrate designed to wick moisture quickly from an exerciser's skin. An underneath layer of top layer 15, i.e., a layer that sits between the surface layer of top layer 15 and the top of placement layer 20, could be constructed to enhance evaporation out of workout mat 10 and/or disperse moisture away from the surface layer of top layer 15 for later evaporation out of workout mat 10. In some non-limiting embodiments, the material may be 2 mm to 3.5 mm neoprene with sharkskin backing. The backing is called sharkskin which is a 2 application process of attaching rubber foam to the backside of the neoprene. This 2 ply foam rubber backing makes the neoprene material have more buoyancy FIG. 4 is a partial planar view of workout mat 10 having a workout mat pocket 30 for securement of workout mat 10 to workout bench 25. Pocket 30 is shown in outline to indicate that a space exists therein. Such space is used to house an end of workout bench 25. This, of course, depends upon the configuration workout bench 25. The best configuration of workout bench 25, for use with workout mat of FIG. 4, is like that shown in FIG. 6.

Figure 5:
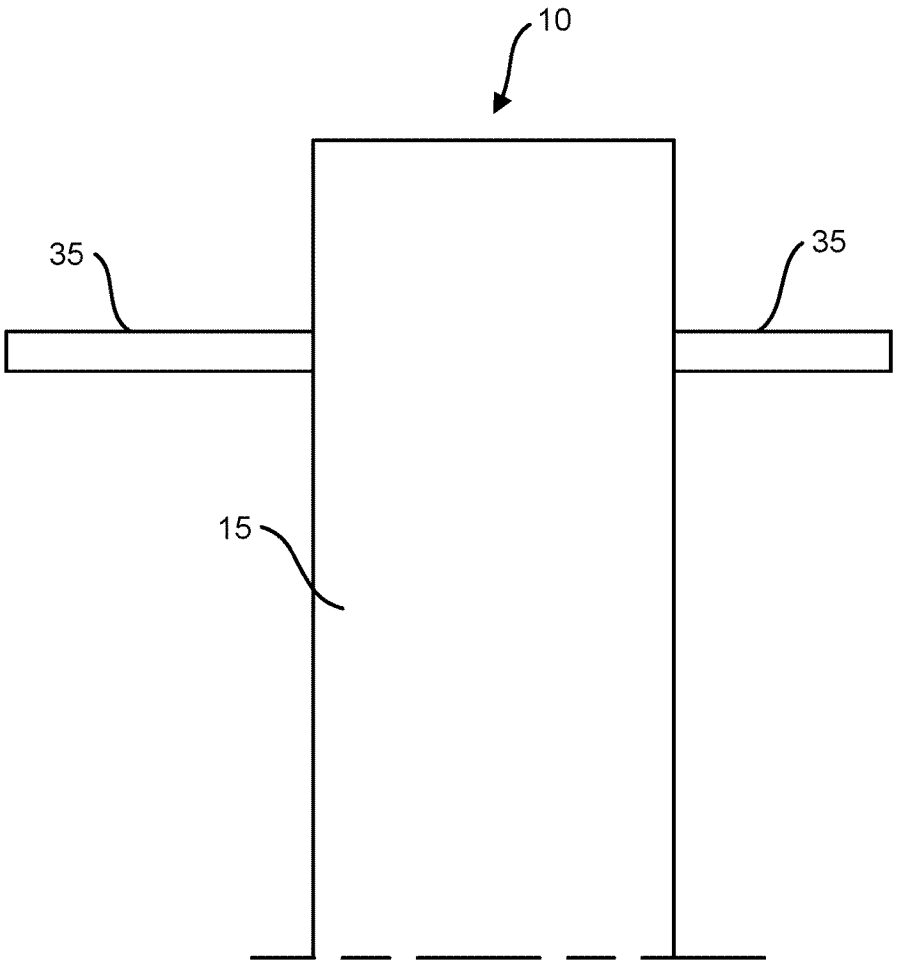
FIG. 5 is a partial planar view of the workout mat having securement straps for securing the workout mat to a workout bench.

FIG. 5 is a partial planar view of the workout mat 10 having securement straps 35 for securing the workout mat to a workout bench. In practice, workout mat 10 is positioned as desired onto workout bench 25. Once laid in place, securement straps 35 are extend around workout bench 25 and, preferably, attach to one another thus holding workout mat 10 in place upon workout bench 25. Attachment means for securement straps 35 can be by the hooks and loops (i.e., VELCRO®) method discussed previously hereinabove. Other commonly known attachment methods_by persons of skill in the art are also included herein.

Securement straps 35 are preferably flexible, at least partially cloth straps attached to the sides of workout mat 10 as shown. Flexibility is a preferred, important feature that enables securement straps 35 to extend as necessary around workout out bench 25.

Figure 6:
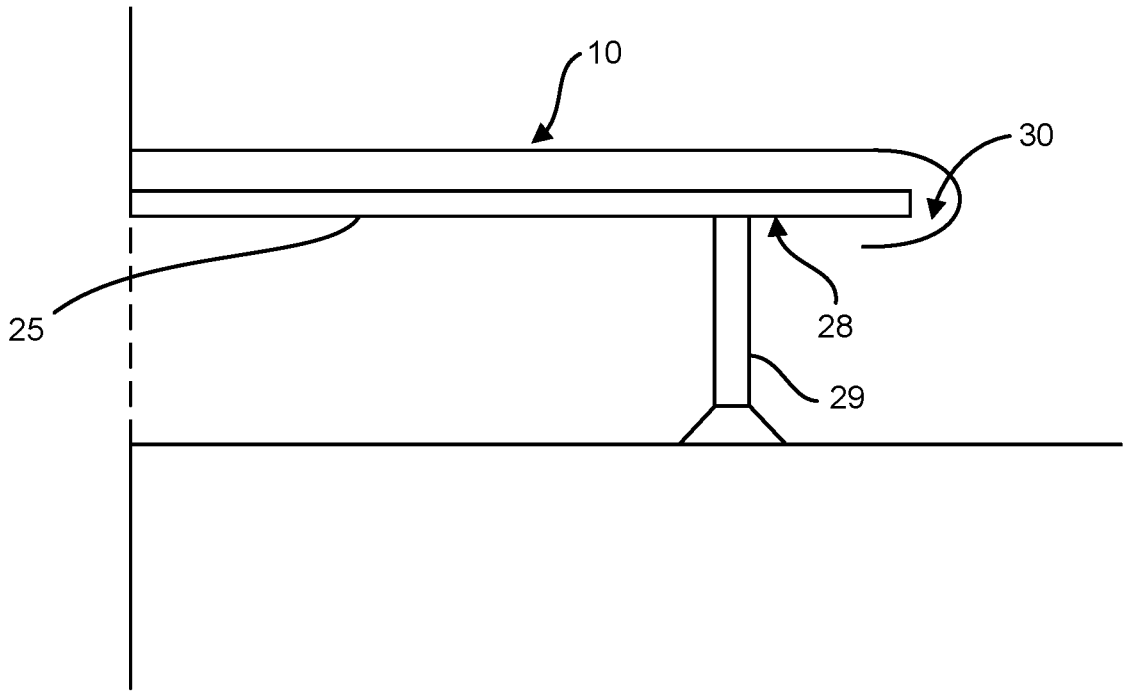
FIG. 6 is a side view a workout mat secured to a workout mat herein.

FIG. 6 provides a partial side view of the application of workout pocket 30 to one end of workout bench 25 for securement of workout mat 10 thereto. As shown, an end of workout bench 25 protrudes outwardly from one of workout bench leg 29 that is attached perpendicularly to the underside of workout bench 25. Pocket 30 forms around end 28 of workout bench 25 in a manner that is meant to partially secure workout mat 10 to workout bench 25. By the term "partially secure", it is meant herein that 1) that such securement is at least partially fixed resisting removal thereof from normal, intended use of pocket 30 from the end of workout bench 25 and 2) an exerciser may readily remove pocket 30 from workout bench 25 when intended.

Pocket 30 may be structurally formed in multiple ways. In one embodiment, pocket 30 is formed from the same material as workout mat 10 and is a folded over portion of workout mat 10. In such instance, the inside of pocket 30 provides quasi-securement of workout mat 10 to workout bench 25. Such securement is not provided by adhesive, but instead by a loose or semi-loose fitting of pocket 30 to one end of workout bench 25.

Pocket 30 is preferably made by two or more stitches (not shown) made at the edges of the shown end of workout mat 10. Such stitching is well known by persons of skill in the art. Preferably, the stitched areas are a one-half inch by one-quarter inch length cotton material sown between the folded material. This piece is sown in zig-zag fashion to stabilize and secure the stitched area. When users use workout mat 10, such use may stretch pocket 30 to fit workout equipment like benches, seats and the backs of seat benches. When stretched, the stitches do not pull into workout mat's 10 material but is strengthened because of the thick cotton stability piece fitted there between.

In one embodiment herein, top layer 15 of workout mat 10 is folded backwards to and stitched about a half inch from both sides of workout mat 10 (not shown) thereby forming a pocket 30. Also preferably, another stitch is sewn a few inches (e.g., about 2 inches) from the left side stitch to create a secondary pocket 40 to hold a small item like hand sanitizer and the like. Secondary pocket 40 enables users to keep their belongings near while working out while being unhindered during workout The front side is neoprene which can be in many different colors. Also the front side can be decaled, logoed, graphically personalized or have statements. The statements, logos and graphics are done mainly on the neoprene side. There are several printing techniques that can be used.

In one preferred embodiment herein, the workout mat can be made from one or multiple pieces of material wherein each surface may be moisture resistance or hydrophobic. The bottom side, regardless of material type should be non-stick. The top side should be moisture resistance and preferably hydrophobic.

The work-out mat's bottom layer has a thick gradient look and finish. The bottom layer is anti-slick. It is designed to be removable by a user applying sufficient force or pull for removal of the work-out mat. This is especially important for workout mats applied to work-out equipment that is not flat, sits upright or sits at least partially upright.

The top or front side of the workout mat is preferably a moisture resistant surface like neoprene. The neoprene top layer should be soft to the skin and not rough. It may comprise any choice of color suitable to the tastes of an exerciser. The front side can be decaled, have logos and the like. Any number or configuration of graphical designs can be added to the front layer for aesthetic appeal.

Because the workout mat material can stretch, and is designed to do so, the pocket between the stitches allows the upper back cuff or pocket to stretch a distance (e.g., two inches). This allows the cuff or pocket to stretch over workout equipment (e.g., nautilus, weight lifting benches).

The flaps of the top portion of the workout mat fold back so that it can be placed onto workout equipment like nautilus and weight room benches. The flaps are held back by, preferably, several Velcro® strips that are either sewn or glued to the backs of the flaps and the anti-slip bottom layer of the workout mat. Also, the Velcro® strips enable the workout mat to retain its rolled orientation when its rolled up post use.

The workout mat comes in a one piece material which means the cut out material is identical to regular dimensions and a one color neoprene front. In the case that the Alpha Transitional NoSweat Mat™ is a two piece the center piece would be a primary color and in the sizes from 15." in width to 50" in length. Then the center piece is centered on top of the base mat of the same material and attached. Remember the youth size is not as wide and the length is shorter. The center top neoprene piece is the same millimeter as the base that it's being attached on top of. This will create a much thicker mat in the center zone which would give more cushion in the weight training area when used on benches and nautilus seats and for nautilus resting points. Also more cushion when users lay vertically on the mat when doing stretching or a designed exercise such as Pilates etc.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A workout mat for placement onto a workout apparatus, comprising:

a body having a first side and a second side, said second side of said body being positioned oppositely to said first side, wherein the top layer consists of neoprene having a 2.5 to 3 mm thickness with a two-ply rubber foam backing;

the body having a placement layer positioned below the top layer with a frictional surface, the top layer bonded to the placement layer with thermal or adhesive bonding, wherein the placement layer consists of frictional members;

a pocket configured to house an end of the workout apparatus to secure the workout mat to the workout apparatus, the pocket formed from a folded over portion of the workout mat and stitched at edges of an end of the workout mat to form stitched areas;

wherein a remainder of the workout mat extends past the pocket, wherein when positioned the remainder covers at least a portion of the workout apparatus.

2. The workout mat of claim 1 further comprising one or more securement straps on sides of the workout mat, the one or more securement straps extendable around the workout apparatus and attach to one another.

3. The workout mat of claim 2 wherein a center portion of the workout mat is thicker in size for more cushion.

4. The workout mat of claim 1, wherein stitched areas are a one- half inch by one-quarter inch length cotton material sown in a zig-zag fashion between folded material wherein stitches are strengthened when pulled.

5. A workout mat for placement onto a workout apparatus comprising:

a body having a first side and a second side, said second side of said body being positioned oppositely to said first side, wherein the top layer consists of neoprene having a thickness of 2 to 3.5 mm with a two-ply rubber foam backing;

a head rest fixedly attached to the body;

a pocket configured to house an end of the workout apparatus to secure the workout mat to the workout apparatus, the pocket formed from a folded over portion of the workout mat and stitched at edges of an end of the workout mat to form stitched areas;

wherein stitched areas of the pocket are of a cotton material sown between the folded over portion wherein stitches are strengthened when pulled and the cotton material sown in a zig-zag fashion wherein a remainder of the workout mat extends past the pocket, wherein when positioned the remainder covers at least a portion of the workout apparatus.

6. The workout mat of claim 5 further comprising a bottom frictional portion constructed to prevent the workout mat from moving once the workout mat is positioned on the workout apparatus.

7. The workout mat of claim 6 further comprising one or more securement straps.

8. The workout mat of claim 5 further comprising a secondary pouch that is sewn into the workout mat.

* * * * *